United States Patent [19]

Grimm et al.

[11] 4,288,995

[45] Sep. 15, 1981

[54] HOUSEHOLD REFRIGERATOR MOVABLE STORAGE ASSEMBLY

[75] Inventors: Bernard J. Grimm; Richard A. Dossett, both of Louisville, Ky.

[73] Assignee: General Electric Company, Louisville, Ky.

[21] Appl. No.: 97,477

[22] Filed: Nov. 26, 1979

[51] Int. Cl.[3] ..... F25D 25/02

[52] U.S. Cl. ..... 62/382

[58] Field of Search ..... 62/78, 265, 382, 408, 62/419, 441; 248/243

[56] References Cited

U.S. PATENT DOCUMENTS

| | | | |
|---|---|---|---|
| 2,960,849 | 11/1960 | O'Connell | 62/382 X |
| 3,108,455 | 10/1963 | Hanson . | |
| 3,126,721 | 3/1964 | Shove . | |
| 3,364,694 | 1/1968 | Cohen et al. . | |
| 3,473,345 | 10/1969 | Pfeiffer et al. . | |
| 3,600,905 | 8/1971 | Dymek et al. | 62/382 |
| 3,656,314 | 4/1972 | Jung . | |
| 4,098,481 | 7/1978 | Johnson et al. | 248/243 |

*Primary Examiner*—Lloyd L. King

*Attorney, Agent, or Firm*—Frederick P. Weidner; Radford M. Reams

[57] ABSTRACT

A movable storage assembly for a refrigerator having a freezer compartment and fresh food compartment, the freezer compartment being separated by a partition interconnected by an air duct, with the air duct having an inlet opening in the freezing compartment and an air outlet opening in the fresh food compartment. The movable storage assembly includes a removable storage pan, a shroud for the pan having a bottom wall and two side walls and open at the front and rear. There is a cover for the pan secured to the shroud and the shroud and pan cooperate to provide an air flow path therebetween. An air director pivotally attached to the rear of the shroud is provided and there are controls, including a movable control mechanism assembly, a linkage member cooperating with the air director and the movable control mechanism assembly to move the air director to open and closed positions to regulate the amount of cold air flowing around the storage pan. The storage assembly is arranged so that it may be removably secured to the inside of the fresh food compartment.

8 Claims, 5 Drawing Figures

HOUSEHOLD REFRIGERATOR MOVABLE STORAGE ASSEMBLY

BACKGROUND OF THE INVENTION

This invention relates to household refrigerators and is more particularly concerned with a combination refrigerator, that is, a refrigerator including a freezer compartment on top and a fresh food compartment below, both of which are cooled by circulating air from the two compartments over a single evaporator employing a single fan to accomplish the circulation. This invention relates to a movable storage assembly having air flow control means for controlling the circulation of air to the storage pan in the fresh food compartment of the refrigerator.

Combination refrigerators, including a single evaporator and a single fan for circulating air from the freezer and fresh food compartments over the evaporator are well known. In the operation of such refrigerators, a major portion of the refrigerated air from the evaporator is directed into the freezer compartment while a smaller portion is directed into the fresh food compartment. In addition, it is well known to direct a portion of the cold air flowing into the fresh food compartment downwardly through an air duct to and around a storage container or pan, thus maintaining the interior of the pan at a slightly lower temperature than other portions of the fresh food compartment. See, for example, U.S. Pat. Nos. 3,656,314; 3,126,721; 3,473,345 and 3,108,455. These pans are particularly useful for the preservation of fresh foods, such as fruit, vegetables and meat, so that they may be stored at temperatures somewhat below those of other stored foods.

It is desirable, however, that such pans have the temperature adjustable or controllable to provide the desired temperature inside the pan regardless of varying conditions that act on the refrigerating system. Such things as the degree of cooling, that is, the temperature of the air as it leaves the evaporator, often depend upon different ambient temperature conditions. For instance, when greater heat leakage occurs under high ambient temperature conditions, such as in the Summer, it often is necessary to provide for a greater circulation of the refrigerated air around the pan to keep the inside at a proper temperature. Moreover, it is highly desirable to be able to control the temperature inside the pan, depending upon the type of food to be stored therein. In particular, when the pan is used for meat storage, the temperature should be lower than if the pan is used for fruits and vegetables. See, for example, U.S. Pat. Nos. 3,600,905 and 3,364,694, wherein there is shown two different arrangements for controlling the quantity of cold air flowing around the storage pan. In addition, it is often desirable to have the storage pan movable within the fresh food compartment of the refrigerator to allow the user to change its location with respect to the shelves so that the storage arrangement will best suit the desires of the user. For instance, in some refrigerators the shelves are movable by attaching to the rear wall of the inside liner parallel tracks with slots into which shelf brackets are removably received. The shelves may then be moved up and down the tracks so that they can be arranged however the user wishes. See, for example, U.S. Pat. No. 4,098,481 that shows such a track assembly. It is also desirable to have the temperature of the interior of the movable storage pan controllable so that it may be used for keeping either meat or vegetables and fruit, again depending upon the desires of the user.

By our invention, there is provided a movable storage assembly, including a storage pan, whereby the user of the refrigerator may adjust the amount of cold air flowing around the pan and thus control the interior temperature of the pan.

SUMMARY OF THE INVENTION

According to one aspect of our invention, there is provided in a refrigerator having a freezer compartment and a fresh food compartment which are separated by a partition and interconnected by an air duct, the air duct having an air inlet opening in the freezer compartment and an air outlet opening in the fresh food compartment, a movable storage assembly having air flow control means in the fresh food compartment. The assembly includes a removable storage pan and a shroud for the pan having a bottom wall and two side walls, and open at the front and rear, said shroud cooperating with the pan to provide an air flow path therebetween. There is provided a cover for the pan which is secured to the shroud. An air director is pivotally attached to the rear of the shroud and a control means is provided which includes a movable control mechanism assembly and a linkage member having means at one end cooperating with the air director to move the air director to open and closed positions to regulate the amount of cold air flowing around the storage pan upon movement of the linkage member. The other end of the linkage member has means responsive to movement of the control mechanism for moving the linkage member. There is also attachment means for removably securing the storage assembly to the inside of the fresh food compartment.

The user of the refrigerator may move the storage assembly within the fresh food compartment and, depending upon the location of the assembly, the user of the refrigerator may also adjust the amount of cold air flowing around the pan and thus control the interior temperature of the pan.

DESCRIPTION OF THE PREFERRED EMBODIMENT

Figure 1:
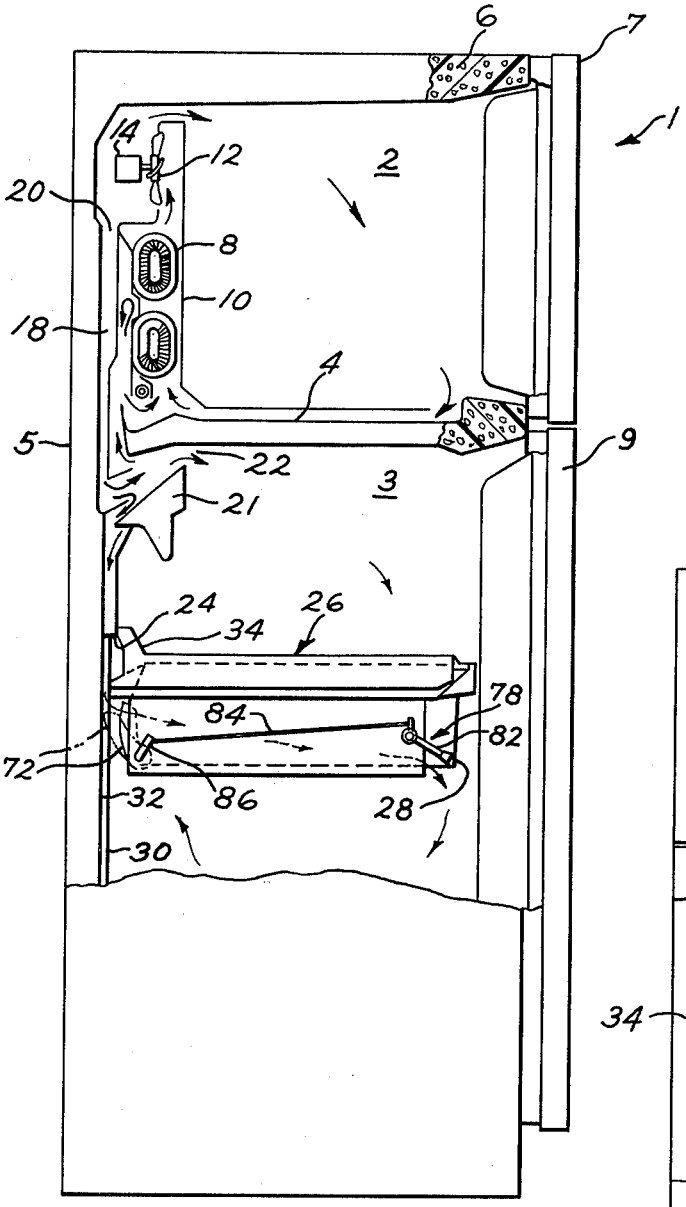
FIG. 1 is a side elevational view, partly in section, of a refrigerator cabinet having a freezer compartment on top and a fresh food compartment on the bottom and embodying one form of the present invention.
Figure 2:
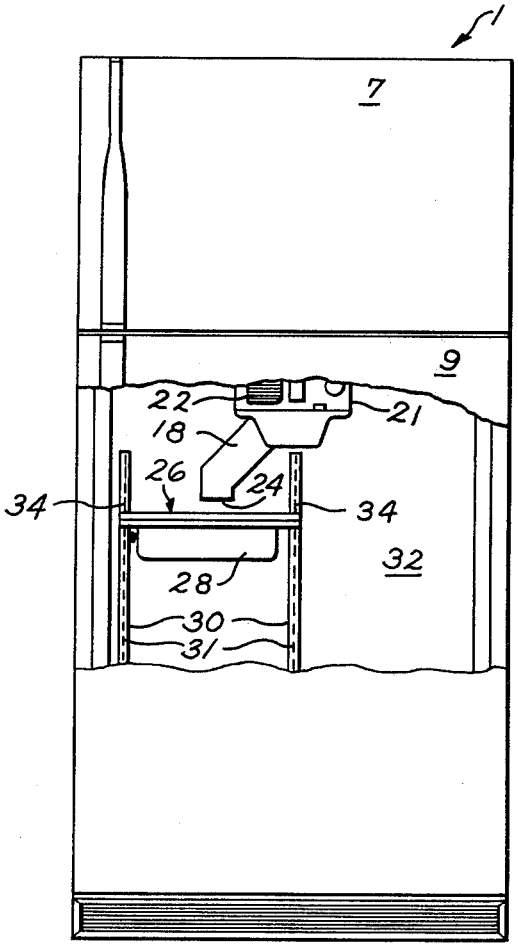
FIG. 2 is a front elevational view of the refrigerator of FIG. 1 having one form of the present invention embodied therein.

With particular reference to FIGS. 1 and 2 of the drawings, there is shown one embodiment of the present invention in the form of a household refrigerator 1, including an upper freezer compartment 2 and a lower fresh food compartment 3 separated from the freezer compartment by an insulated partition 4. The respective compartments are also separated from the outer shell or outer cabinet walls 5 and the spaces between the compartments and these walls are filled by means of insulation 6. A hinged door 7 permits access to the freezer compartment 2 and a hinged door 9 permits access to the fresh food compartment 3.

Both of the compartments are maintained at the desired refrigerating temperatures by means of a single evaporator 8 which operates at a below freezing temperature and is arranged within the freezer compartment 2 and separated from the food storage area of the freezer by a liner 10 for protection purposes. For directing air cooled by the evaporator 8 into the two compartments 2 and 3, there is provided a forced air circulating system, including a single air circulating means in the form of a fan 12 driven by a motor 14. Most of the air flow passes into the forward or food storage area portion of the freezer compartment 2 through air passage 16, while a smaller portion of the air is directed through an air duct 18 which is located at the rear of both compartments. The air duct 18 has an air inlet opening 20 in the freezer compartment 2 where the cold air enters the air duct and then it is directed downwardly to the fresh food compartment 3. The air duct 18 has a baffle 21 with a discharge opening 22 for introducing a portion of the cold air into the top of the fresh food compartment 3 while a portion of the cold air flow is directed downwardly through the air duct 18 to near the middle of the fresh food compartment where there is an air outlet opening 24.

As shown in FIGS. 1 and 2, there is a movable storage assembly 26, including a removable storage pan 28, in the fresh food compartment 3 in air flow communication with the air duct outlet opening 24. The movable storage assembly 26 is arranged to allow, if the refrigerator user so desires, the cold air exiting the air outlet opening 24 to impinge upon and surround the pan 28 and thus lower the temperature inside the pan. The pan 28 is arranged in the storage assembly 26 so that cold air from the air duct outlet opening 24 flows downwardly and forwardly around the pan 28 then through the front of the storage assembly 26 into the fresh food compartment 3. The air flow is shown by arrows in FIG. 1. By this direct contact of cold air on the pan 28, the temperature of the pan is maintained at a slightly lower temperature than the remainder of the fresh food compartment 3. It is desirable to control the temperature in the pan 28 and this may be accomplished by controlling the amount of cold air contacting and surrounding the pan from the air outlet opening 24.

In household refrigerators, it is often desirable to provide vertically adjustable shelves so that the interior configuration of a refrigerator may be arranged to accommodate different sizes of foods at different times. To accomplish this, there is provided two spaced, parallel, vertical elongated strips or tracks 30 having a plurality of slots 31 along their length. Each of these tracks is secured by suitable means to the interior liner 32 of the refrigerator. For placing shelves between the spaced tracks 30, there are provided brackets 34 for each track which are movable vertically along the tracks 30. The brackets 34 are cantilevered and include a shelf supporting member 36 which has, at one end thereof, a track securing portion 38. The track securing portion 38 includes an upper hook-shaped attachment means or element 40 which is removably inserted into one of the slots 31 of the tracks 30. The track securing portion 38 of the bracket 34 also has located below the hook-shaped element 40 a tab 42 which is dimensioned to be removably inserted in one of the slots 31 of the tracks 30. The tab 42 is utilized to stabilize the bracket 34 when it is engaged in the tracks 30. With this tab 42, lateral movement of the track securing portion 38 of the bracket 34 is limited and also unintentional upward movement of the track securing portion 38 is prevented. By this arrangement then, to remove the bracket 34 from the tracks 30, the bracket shelf supporting member 36 is rotated upwardly to pivot about hook-shaped element 40 and thus disengage the tab 42 from its slot and then remove the hook-shaped element 40 from engagement with its slot.

The brackets 34 are attached to both sides of a shelf or cover 44 which has a horizontal panel 46 and downwardly depending side walls 48 and 50 to which the shelf supporting members 36 of the brackets are attached. The cover 44 has an inwardly open channel on both side walls 48 and 50 dimensioned to slidably receive the pan 28. Both channels are of the same configuration. For instance, the channel on side wall 48 uses the inner surface 49 of the side wall as the bottom wall and two legs 52 and 54 are formed on the inner surface of side wall 48 which are parallel to and spaced from each other to receive a downwardly turned lip 56 on each side of the pan 28.

Attached to the shelf or cover 44 is a shroud 58 for the pan 28 and the shroud 58 has a bottom wall 60 and side walls 62 and 64. The shroud is open at the front and rear. The shroud 58 may be secured to the shelf or cover 44 by any suitable means and, in the case of the preferred embodiment, the upper end of the side walls 62 and 64 form an outwardly open channel 65 and 66 in side walls 62 and 64 respectively. These channels 65 and 66 cooperate with inwardly depending flanges 68 and 70 of the side walls 48 and 50 respectively of the cover 44. In this manner the shroud 58 is supported by and underlies the cover 44 and may be secured in place by any suitable means.

Figure 4:
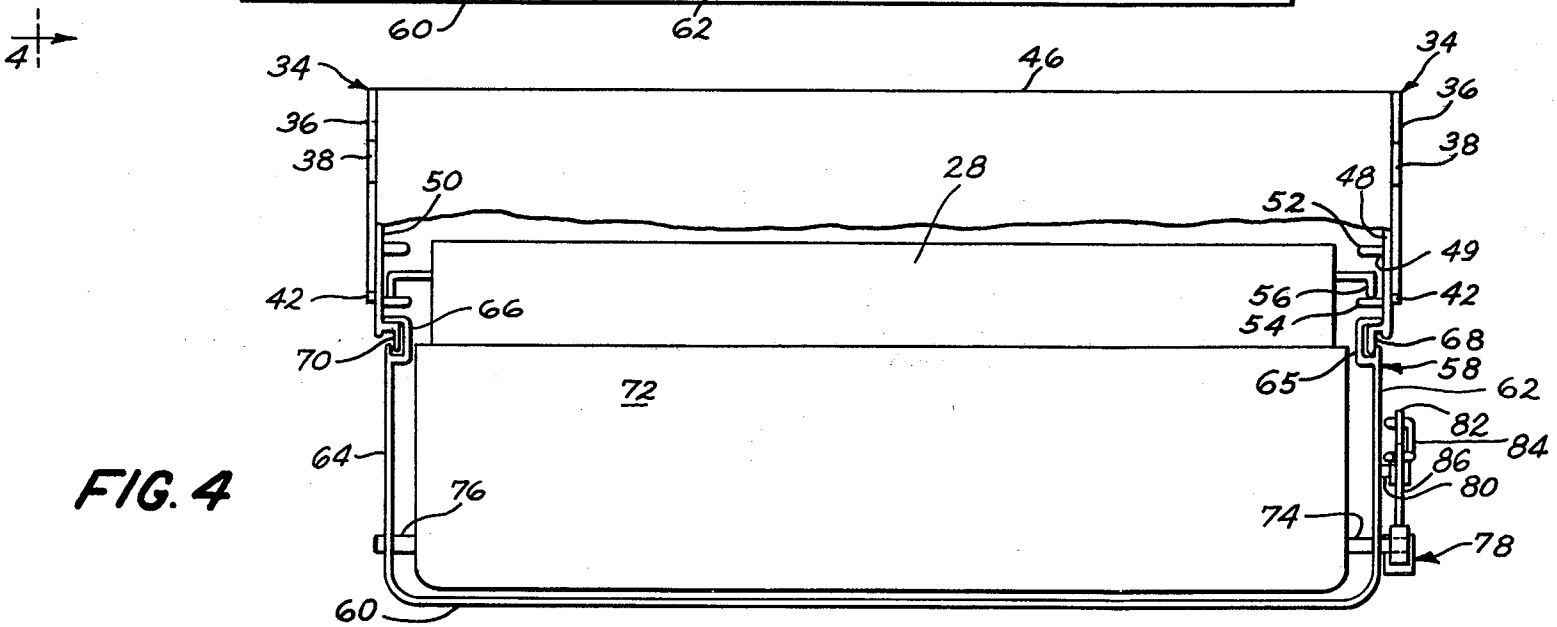
FIG. 4 is a rear elevational view tkaen along lines 4—4 of FIG. 3.
Figure 5:
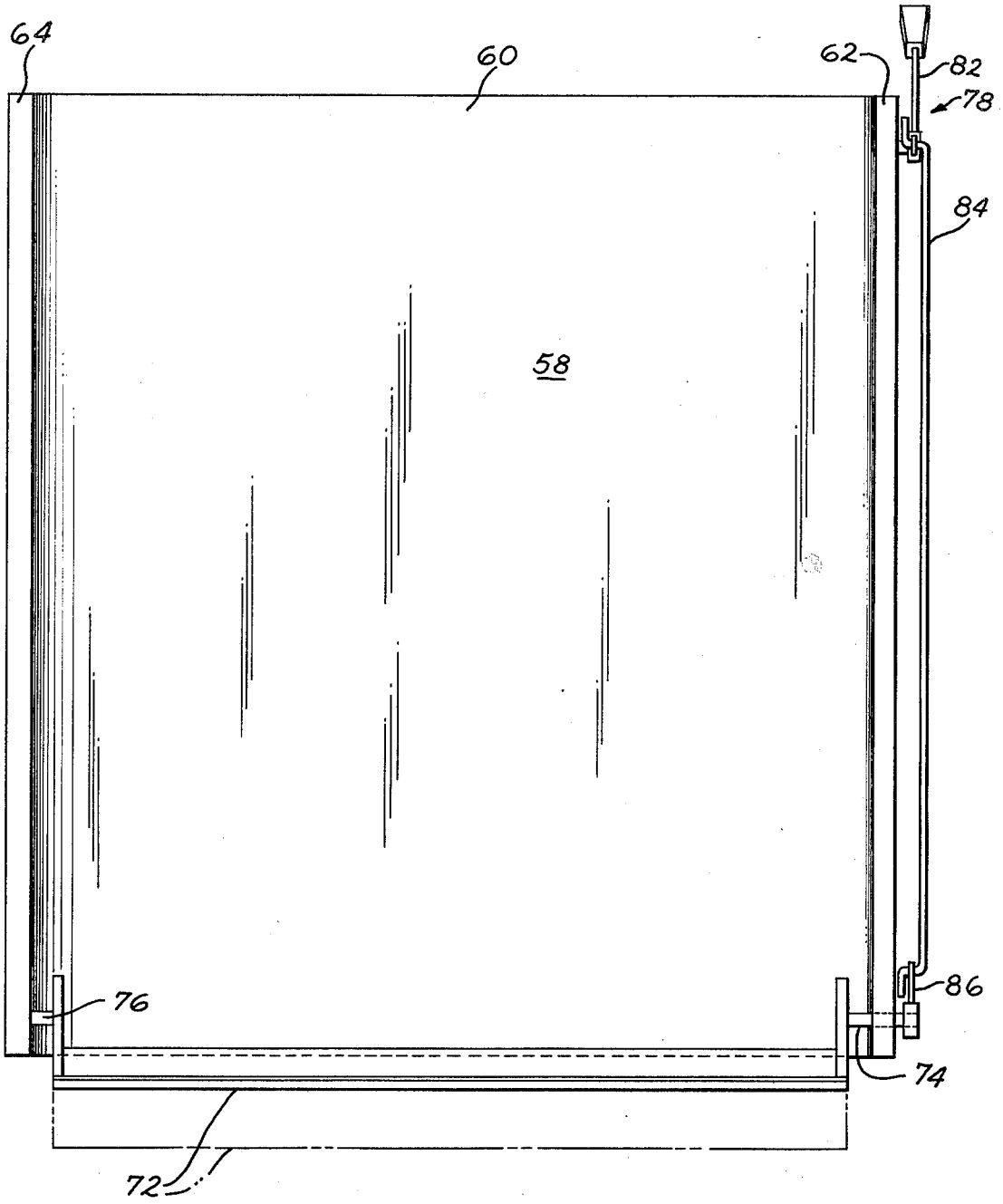
FIG. 5 is a top plan view showing a portion of the movable storage assembly of the present invention.

With reference to FIG. 4 in particular, it will be noted that the bottom wall 60 and side walls 62 and 64 are spaced outwardly of the pan 28 to provide an air flow path between the pan and the shroud, as will be discussed later.

Figure 3:
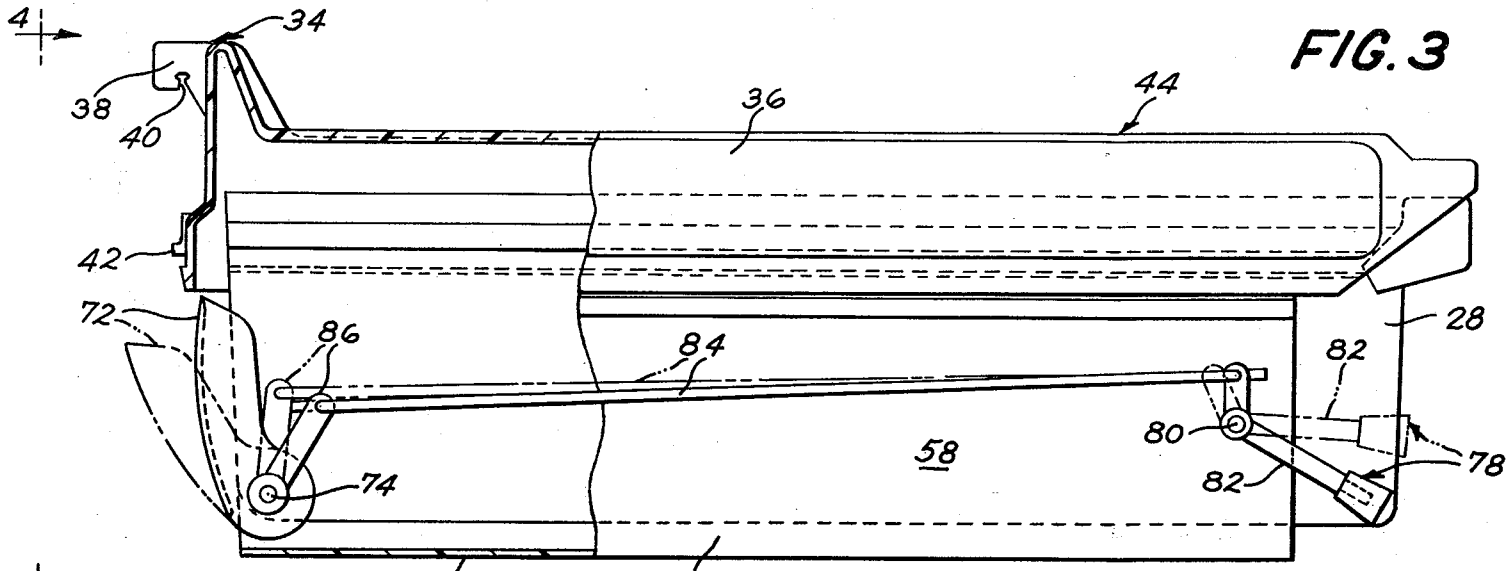
FIG. 3 is a side elevational view partially in cross section of the movable storage assembly of the present invention showing one position of the control means in full line and another position in dotted line.

The movable storage assembly 26 also includes an air director 72 which is pivotally attached to the rear of the shroud by pivots 74 and 76 whjch are secured to the side walls 62 and 64 respectively of the shroud 58. The air director 72 may be pivoted, as shown in FIG. 3, from a closed position, as shown in full line, to an open position, as shown in dotted line. Control means are provided for moving the air director 72 to the open or closed positions and include a movable control mechanism assembly 78. The movable control mechanism assembly 78 is pivotally attached at the front of the movable storage assembly 26 and is secured to the side wall 62 of the shroud 58 as by a pivot 80. The movable control mechanism assembly 78 has a lever arm 82 which is movable about pivot 80. Connected to the movable control mechanism assembly 78 is a linkage member 84 which has one end thereof connected to the movable control mechanism assembly 48 and the opposite end connected to the air director 72 via a lever arm 86. As shown in FIG. 3, when lever arm 82 is manually moved to its down position by the refrigerator user, the air director 72 is in the closed position as indicated by full line of the air director 72, the linkage member 84 and the movable control mechanism assembly 78. When the lever arm 82 is in its raised or upper position, the air director 72 is in the open position as shown by dotted line.

By the above described structural arrangement of the refrigerator and the movable storage assembly 26, the refrigerator user may position or move the storage assembly anywhere up and down along the tracks 30. It will be understood that there may be more than two tracks so that half shelves on both sides of the interior of the fresh food compartment may be utilized. The movable storage assembly 26 may also be used on either side of the fresh food compartment. The amount of cold air available to the storage assembly 26 will depend upon its location relative to the air outlet opening 24. The closer they are to each other, the more cold air will be available. In the embodiment shown in FIGS. 1 and 2, the air outlet opening 24 is located between the tracks 30 near the upper portions thereof. With the movable storage assembly 26 in the position as shown, it would have more cold air available from the air outlet opening 24 than if it is located near the bottom of the tracks 30. If the storage assembly 26 is on the other side of the fresh food compartment, very little cold air from the air outlet opening 24 would be available.

The desired temperature inside the pan 28 will depend upon the type of food stored therein . Usually, meat should be stored in the pan at a temperature lower than that for vegetables and fruit. If the user wishes to store meat in the pan 28, then it is desirable to have the cold air exiting air outlet opening 24 directed around the pan 28. This is accomplished by the user moving the control mechanism assembly 78 to the dotted line position shown in FIG. 3, thus the linkage member 84 moves the air director 72 to the open position and allows the cold air flowing downwardly from the air outlet opening 24 into the shroud 58 and along the side walls 62 and 64 and the bottom wall 60 which are spaced outwardly of the pan 28. The cold air flows from the rear of the movable storage assembly 26 to the front and out into the fresh food compartment 3. The air flow path is shown by arrows in FIG. 1. If the user desires to store fruits or vegetables in the pan 28, then the movable control mechansim assembly 78 is moved to the full line position shown in FIG. 3 and that moves the air director 72 to the closed position. It will be understood also that the user may wish to control the amount of cold air flowing around the pan 28, depending upon the location of the movable storage assembly 26 relative to the air outlet opening 24, that is, if the movable storage assembly 26 is located on the tracks 30 near the air outlet opening 24, the cold air flow is more directly available than if it is further away from the air outlet opening 24.

The cover 44 not only serves as a cover for the pan 28, but the upper surface thereof may be used as a shelf for setting other refrigerated foods.

The foregoing is a description of the preferred embodiment of the invention and it should be understood that variations may be made thereto without departing from the true spirit of the invention, as defined in the appended claims.

What is claimed is:

1. In a refrigerator having a fresh food compartment having side and rear walls, an air duct having an air outlet opening in the fresh food compartment for delivering refrigerated air to the fresh food compartment, a movable storage assembly having air flow control means in the fresh food compartment comprising:

a removable storage pan;

a shroud for the pan having a bottom wall and two side walls and open at the front and rear, said shroud cooperating with the pan to provide an air flow path therebetween;

a cover for the pan secured to the shroud;

an air director pivotally attached to the rear of the shroud;

control means including a movable control mechanism assembly, a linkage member having at one end cooperating with the air director to move the air director to open and closed positions to regulate the amount of cold air flowing around the storage pan upon movement of the linkage member, and the other end having means responsive to movement of the control mechanism for moving the linkage member; and attachment means for removably securing the storage assembly to the inside of the fresh food compartment.

2. In the refrigerator of claim 1 wherein the air director is pivotally secured at each end thereof to the side walls of the shroud.

3. In the refrigerator of claim 1 wherein the movable control mechanism is an arm pivotally secured to the side wall of the shroud and the arm is moved vertically to regulate the amount of cold air flowing around the pan by the air director.

4. In the refrigerator of claim 1 wherein the movable control mechanism is located at the front of the storage assembly.

5. In the refrigerator of claim 1 wherein the fresh food compartment has two spaced, vertical, parallel tracks having a plurality of slots along their length and the attachment means for the storage assembly are brackets having hook-shaped means at one end removably inserted in the slots of the tracks.

6. In the refrigerator of claim 5 wherein the tracks are secured to the rear wall of the fresh food compartment.

7. In the refrigerator of claim 5 wherein the air duct outlet opening is located between the tracks near the upper portions thereof.

8. In the refrigerator of claim 5 wherein the brackets are secured to the cover.

* * * * *